US005476315A

United States Patent [19]

Lin

[11] Patent Number: 5,476,315

[45] Date of Patent: Dec. 19, 1995

[54] CORNER ASSEMBLY FOR CABINET SIDE PANEL

[75] Inventor: Ching-Hua Lin, Taipei, Taiwan

[73] Assignee: UB Office Systems, Inc., Taipei, Taiwan

[21] Appl. No.: 268,560

[22] Filed: Jul. 6, 1994

[51] Int. Cl.[6] ..... A47B 47/00

[52] U.S. Cl. ..... 312/265.6

[58] Field of Search ..... 312/265.1–265.6, 312/140.1, 140.3, 109, 257, 263, 204, 213, 228, 138.1, 111, 236; 52/716.1, 716.4, 716.6, 716.8, 717.05, 718.04, 463, 716.3

[56] References Cited

U.S. PATENT DOCUMENTS

| | | | |
|---|---|---|---|
| 1,690,286 | 11/1928 | Fitch et al. | 312/140.3 X |
| 2,990,229 | 6/1961 | Engelbrecht | 312/265.4 |
| 4,053,192 | 10/1977 | Spetner | 312/265.5 X |
| 4,351,244 | 9/1982 | Suttles | 312/263 X |
| 4,600,252 | 7/1986 | Barber | 312/265.5 X |
| 4,836,626 | 6/1989 | Taylor et al. | 312/263 X |
| 4,842,351 | 7/1989 | Röck et al. | 312/263 |
| 5,039,177 | 8/1991 | Newell et al. | 312/111 |

FOREIGN PATENT DOCUMENTS

| | | | |
|---|---|---|---|
| 2067887 | 8/1981 | United Kingdom | 312/265.1 |

*Primary Examiner*—Kenneth J. Dorner
*Assistant Examiner*—Robert J. Sandy
*Attorney, Agent, or Firm*—Bacon & Thomas

[57] ABSTRACT

The corner of a cabinet side panel is defined by a longitudinal frame strip having a C-shaped cross-sectional configuration and provided with a lock strip along one longitudinal edge and a plurality of tabs spaced along the other longitudinal edge. The edge of the side panel is provided with an insertion frame that includes a lock flange and a plurality of rectangular slots for respective engagement by the lock strip and tabs of the frame strip.

2 Claims, 4 Drawing Sheets

CORNER ASSEMBLY FOR CABINET SIDE PANEL

FIELD OF THE INVENTION

The invention herein consists of a kind of cabinet side panel interlocking frame strip, specifically referring to a kind of decorative embellishment that is attached to the four corners of the cabinet to enhance the visual attractiveness of the cabinet and, furthermore, offers a fast and convenient interlocking frame strip of innovative structure which enables the interlocking frame strip of a cabinet side panel to have more practical value.

BACKGROUND OF THE INVENTION

Following the assembly of a conventional cabinet side panels and rear panels, the appearance of the four corners consists of a right angle, the sharpness of which easily leads to serious injury from impact in business offices, and there have been no breakthroughs in the improvement of the right angular form. The conventional improvement technique usually consists of reshaping the corners into a 45-degree angle or rounding off the edges. However, since the four corners are radically modified, the cabinet is given an unrefined appearance and requires increased manufacturing complication and difficulty. To enable the structure of the cabinet corners to be even more practical, the inventor of the invention herein has spent many years of professional experience conducting intensive research and development to achieve the best practical value of the invention herein. Furthermore, the invention herein has undergone many special tests and modifications before finally culminating in the completion of an improved structure cabinet side panel interlocking frame strip that is innovative in nature.

SUMMARY OF THE INVENTION

Therefore, the primary objective of the invention herein is to offer a kind of improved structure cabinet side panel interlocking frame strip that is utilized to enhance the decorative embellishment and attractiveness of the four corners of a cabinet, which furthermore has a simplified interlocking frame strip operation procedure with increased practicality and convenience.

To enable the evaluation personnel to have a more comprehensive understanding of the special structural characteristics and innovative aspects of the invention herein, the following preferred embodiments of the invention herein and detailed description of the drawings have been included to facilitate an explanation of the advantages and features. However, the description of the preferred embodiments below shall not construe any limitation whatsoever with regard to the claims of the invention herein.

Figure 1:
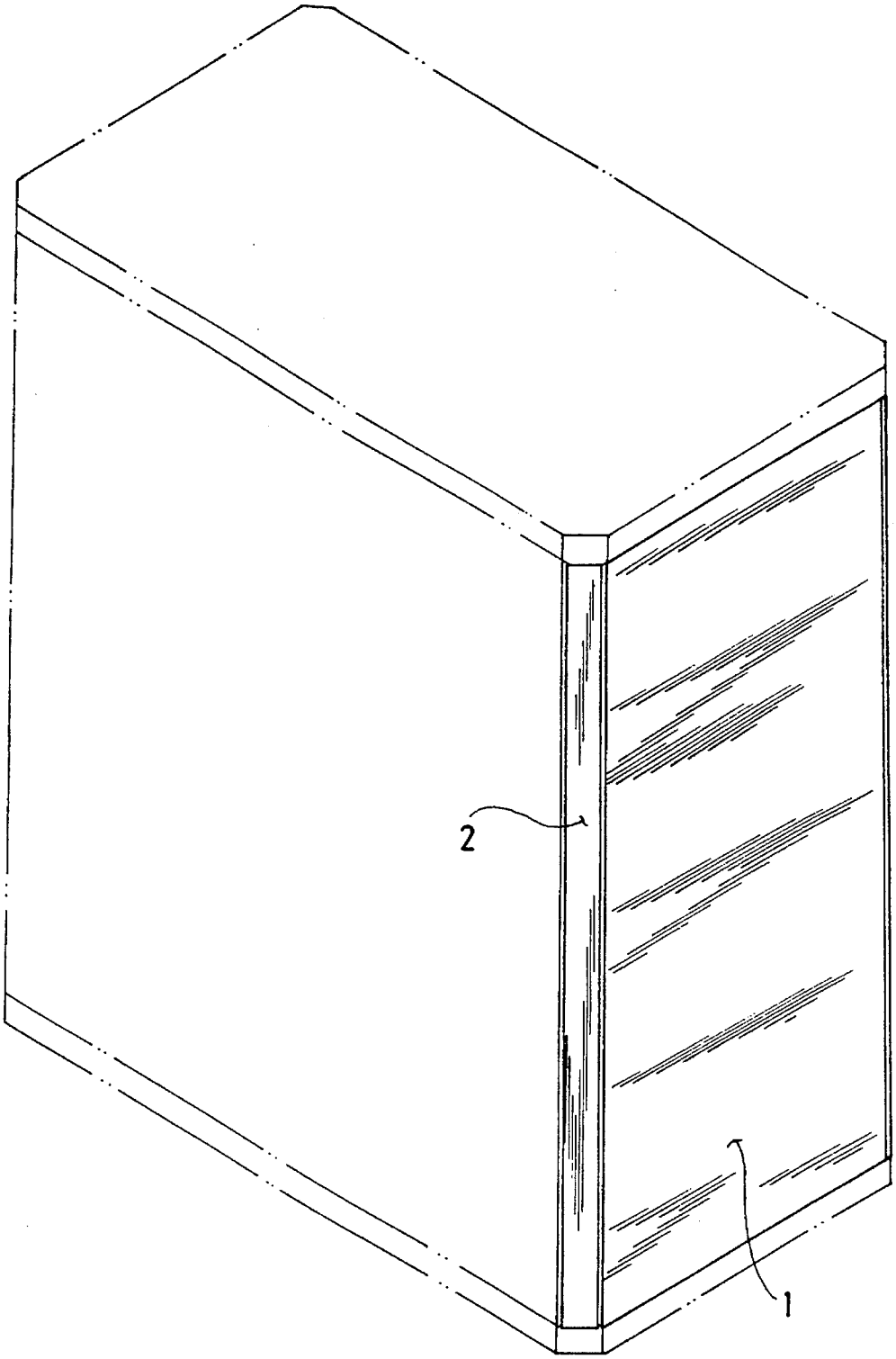
FIG. 1 is a perspective of the assembled structure of the invention herein.

COMPONENT NAMES AND NUMBERS OF THE DRAWINGS (1) Cabinet side panel
(10) Rectangular slot
(11) Insertion frame
(12) Lock flange
(2) Interlocking frame strip
(21) Protruding tab
(22) Lock strip

DETAILED DESCRIPTION OF THE INVENTION

As indicated in FIG. 1, the improved structure cabinet side panel interlocking frame strip of the invention herein consists firstly of the side panel, rear side panel, upper frame, lower frame and other structural components of an assembled cabinet (the assembly technology and components of the aforesaid cabinet are achievable by technical personnel and are not innovative features of the invention herein, so they shall not be further elaborated herein) and the cabinet side panel (1) as assembled to the interlocking frame strip (2) are therein depicted.

Figure 2:
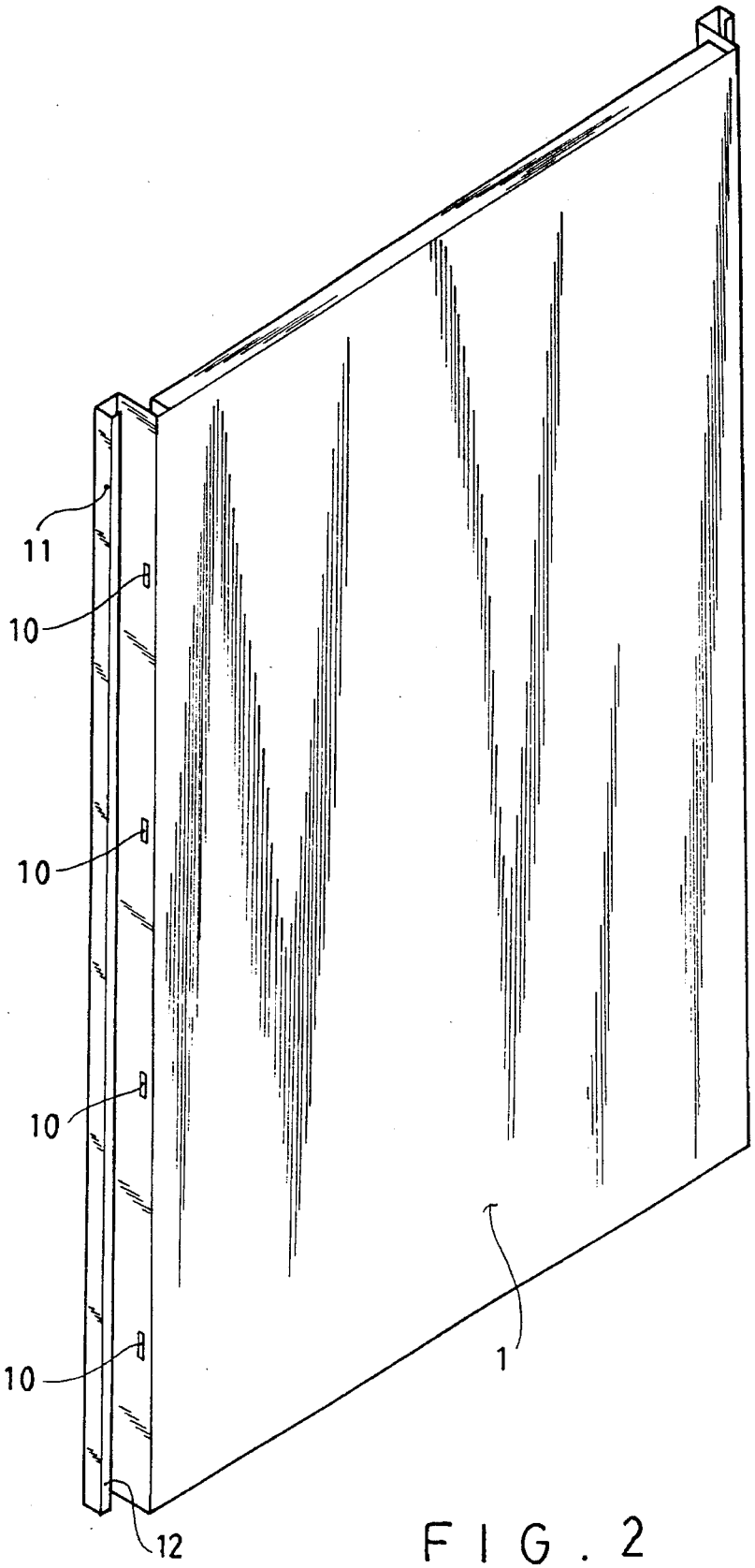
FIG. 2 is a perspective of the side panel of the invention herein.

As indicated in FIG. 2, the cabinet side panel (1) of the invention herein is a press formed component with an insertion frame (11) on two sides and a plurality of rectangular slots (10) are machined along the inner extent of the aforesaid insertion frame (11). Furthermore, there is a lock flange (12) along the outer extent of the insertion frame (11). The aforesaid cabinet side panel (1) is fastened with screws to the rear side panel, lower frame, upper frame and other structural components of the cabinet or can be assembled by interlocking or welding.

Figure 3:
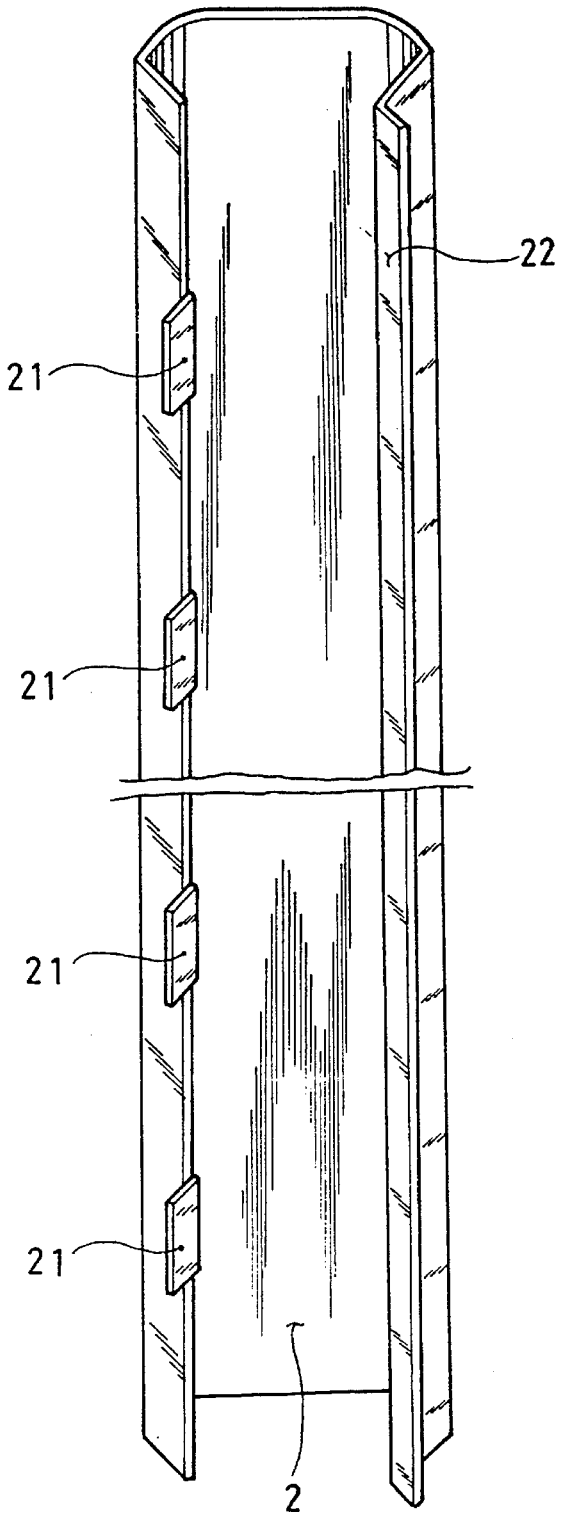
FIG. 3 is an isometric view of the interlocking frame strip of the invention herein.

As indicated in FIG. 3, the interlocking frame strip (2) of the invention herein is press formed into a curved shape such that the end of the aforesaid interlocking frame strip (2) resembles a C-shaped configuration, and furthermore has a narrow lengthwise lock strip (22) and a number of protruding tabs (21), while the outer surface on the interlocking frame strip (2) is of a graduated contoured curvature, of which the length and width factors of the protruding tabs (21) are dependent upon the height dimensions of the cabinet.

Figure 4:
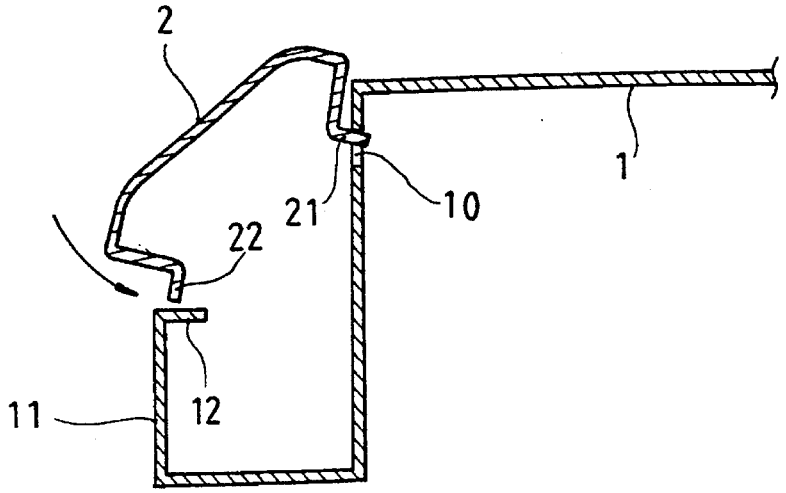
FIG. 4 is a cross-sectional view of the interlocking frame strip in the process of assembly to the side panel of the invention herein.
Figure 5:
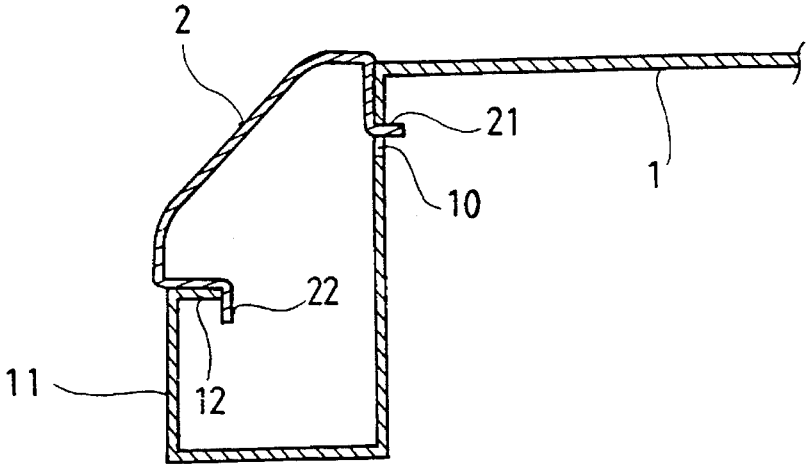
FIG. 5 is a cross-sectional view of the interlocking frame strip assembled to the side panel of the invention herein.

As indicated in FIG. 4 and FIG. 5, the interlocking frame strip (2) of the invention herein is first positioned so that the protruding tabs (21), are inserted into the rectangular slots (10) in the insertion frame (11) of the cabinet side panel (1) and frame strips (2) is pressed until the lock strip (22) of the interlocking frame strip (2) is actuated, which causes the lock flange (22) to interlock onto the lock strip (12) on the outside of the insertion frame (11), an operation that can be conducted quickly and positively, while offering convenient practicality during installation.

The aforementioned technological content and structural features of the invention herein contribute to increasing the practical value of the invention herein and, furthermore, the procedure for assembling the components does not require labor costs for welding and screw fastening, thereby demonstrating the evident progressiveness of the invention herein.

In summation of the forgoing detailed description, the invention herein is an improvement over the disadvantages of the conventional technology and definitely more advanced and innovative than similar known products.

What is claimed is:

1. A corner assembly for a cabinet side panel comprising:

a) a longitudinal insertion frame for extending along a corner edge of the side panel, the insertion frame including a plurality of longitudinally spaced slots and an inwardly directed longitudinal lock flange;

b) a longitudinal frame strip having a substantially C-shaped cross-sectional configuration and including a pair of longitudinal edges, one longitudinal edge defining a lock strip and the other longitudinal edge defining a plurality of spaced tabs; and c) the frame strip being engageable to the insertion frame by inserting the tabs within the slots and engaging the lock strip onto the lock flange.

2. The corner assembly of claim 1 wherein the side panel includes a pair of insertion frames extending along opposite edges thereof and a pair of frame strips.

* * * * *